US010844305B2

(12) United States Patent
Visser et al.

(10) Patent No.: US 10,844,305 B2
(45) Date of Patent: Nov. 24, 2020

(54) PROCESS FOR PREPARING A GREASE

(71) Applicant: SHELL OIL COMPANY, Houston, TX (US)

(72) Inventors: Thomas Jakob Visser, Groningen (NL); Adam Petrus Van Zwieten, Groningen (NL); Matthias Eggenstein, Hamburg (DE)

(73) Assignee: Shell Oil Company, Houston, TX (US)

( * ) Notice: Subject to any disclaimer, the term of this patent is extended or adjusted under 35 U.S.C. 154(b) by 24 days.

(21) Appl. No.: 15/746,548

(22) PCT Filed: Jul. 22, 2016

(86) PCT No.: PCT/EP2016/067560
§ 371 (c)(1),
(2) Date: Jan. 22, 2018

(87) PCT Pub. No.: WO2017/017020
PCT Pub. Date: Feb. 2, 2017

(65) Prior Publication Data

US 2018/0223212 A1 Aug. 9, 2018

(30) Foreign Application Priority Data

Jul. 24, 2015 (EP) ..... 15178303

(51) Int. Cl.

| | |
|---|---|
| ***C10L 1/22*** | (2006.01) |
| ***C10M 135/14*** | (2006.01) |
| ***C10M 141/10*** | (2006.01) |
| ***C10M 115/08*** | (2006.01) |
| ***C10M 177/00*** | (2006.01) |
| *C10N 50/10* | (2006.01) |
| *C10N 70/00* | (2006.01) |

(52) U.S. Cl.
CPC ..... *C10M 115/08* (2013.01); *C10M 177/00* (2013.01); *C10M 2215/0813* (2013.01); *C10N 2050/10* (2013.01); *C10N 2070/00* (2013.01)

(58) Field of Classification Search
CPC ..... C10M 149/20; C10M 2217/045; C10M 115/08; C10M 177/00; C10M 2215/0813; C10N 2050/10; C10N 2070/00
USPC ..... 508/551; 564/160; 558/445
See application file for complete search history.

(56) References Cited

U.S. PATENT DOCUMENTS 4,978,786 A * 12/1990 Messina ..... C07C 233/16 564/160
2010/0105586 A1* 4/2010 Bodesheim ..... C10M 133/40 508/244

* cited by examiner

*Primary Examiner* — Prem C Singh
*Assistant Examiner* — Francis C Campanell

(57) ABSTRACT

The invention provides for a process for preparing a lubricating grease. The process can be carried out in the presence of a base oil and avoids the use of diisocyanate reagents.

10 Claims, No Drawings

PROCESS FOR PREPARING A GREASE

PRIORITY CLAIM

The present application is the National Stage (§ 371) of International Application No. PCT/EP2016/067560, filed Jul. 22, 2016, which claims priority from European Patent Application number 15178303.2 filed Jul. 24, 2015 incorporated herein by reference.

FIELD OF THE INVENTION

The invention relates to a process for preparing a lubricating grease.

BACKGROUND OF THE INVENTION

Greases are used to provide lubrication in a variety of applications including bearings for constant-velocity joints, ball joints, wheel bearings, alternators, cooling fans, ball screws, linear guides of machine tools, sliding areas of construction equipment, and bearings and gears in steel equipment and various other industrial mechanical facilities.

U.S. Pat. No. 3,119,869 discloses a thixotropic grease comprising an abietyl oxamide compound having the general formula (x):

(x)

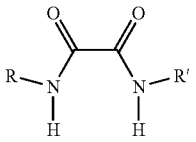

wherein R and R' are the same or different abietyl radicals selected from the group consisting of a dehydroabietyl radical, a dihydroabietyl radical and tetrahydroabietyl radical. The greases can be prepared by heating a mixture of an abietyl amine and an oxalic acid diester in the presence of a basic catalyst. The reaction product may be combined with a base oil to form a grease.

Urea greases contain low molecular weight organic compounds, sometimes referred to as polyureas. The polyureas are typically synthesised from isocyanates and amines. The reaction of the diisocyanate and the amine does not require any heat and proceeds at a good rate at room temperature. There are no reaction byproducts that must be removed. However, the diisocyanate reagents are highly toxic and volatile and require special treatment and handling equipment. It is desirable to find an alternative route for the manufacture of greases that avoids the use of diisocyanate reagents.

WO2014122273 discloses a process that provides a urea grease, but avoids the use of diisocyanate reagents. The inventors have found that this manufacturing process is hampered by lower reactivity of the biscarbamate precursor compared to diisocyanates. This results in extended residence times of the grease within the manufacturing vessel. Furthermore a catalyst is needed for the reaction and this remains in the finished product and might form an undesired component.

The present inventors have sought to provide an improved process for the manufacture of greases that avoids the use of diisocyanate reagents.

SUMMARY OF THE INVENTION

Accordingly, the invention provides a process for preparing a grease comprising a step in which a compound of formula (a) is reacted with a compound of formula (b) to provide a compound of formula (c):

(a)

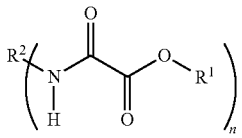

(b)

$R^3—NH_2$ (c)

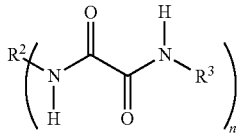

wherein $R^1$ is chosen from hydrocarbyl having from 1 to 30 carbon atoms, $R^2$ is chosen from hydrocarbyl or hydrocarbylene comprising from 1 to 30 carbon atoms, $R^3$ is chosen from hydrocarbyl comprising from 2 to 30 carbon atoms and n is an integer of 1 or more, wherein the reaction of the compound of formula (a) with the compound of formula (b) is carried out in the presence of a base oil, or the compound of formula (c) is mixed with a base oil.

The inventors have surprisingly found that the compound of formula (c) which results from the reaction of the compounds of formula (a) and formula (b) functions effectively as a thickener for a lubricating grease. The process of the invention provides an effective grease, but avoids the use of diisocyanate reagents.

The invention further provides a lubricating grease comprising a compound of formula (c):

(c)

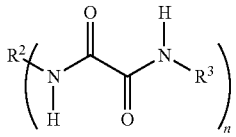

wherein $R^2$ is chosen from hydrocarbyl or hydrocarbylene comprising from 1 to 30 carbon atoms, $R^3$ is chosen from hydrocarbyl comprising from 2 to 30 carbon atoms and n is an integer of 2 or more; and a base oil. Such a grease can be prepared by the process of the invention, avoiding the use of diisocyanate reagents.

DETAILED DESCRIPTION OF THE INVENTION

The term "hydrocarbyl" as used in the present description refers to a monovalent organic radical comprising hydrogen and carbon and may be aliphatic, aromatic or alicyclic, for example, but not limited to, aralkyl, alkyl, aryl, cycloalkyl, alkylcycloalkyl, or a combination thereof, and may be saturated or olefinically unsaturated (one or more double-bonded carbons, conjugated or non-conjugated). The term "hydrocarbylene" as used in the present description refers to a multivalent (e.g. divalent, trivalent etc.) organic radical comprising hydrogen and carbon and may be aliphatic, aromatic or alicyclic, for example, but not limited to, aralkyl, alkyl, aryl, cycloalkyl or alkylcycloalkyl, and may be saturated or olefinically unsaturated (one or more double-bonded carbons, conjugated or non-conjugated).

The invention provides a process for the preparation of a grease. A compound of formula (a) and a compound of formula (b) are reacted:

(a)

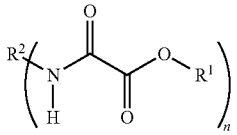

(b)

$R^3—NH_2$ $R^1$ is chosen from hydrocarbyl having from 1 to 30 carbon atoms. $R^1$ is preferably a hydrocarbyl group comprising only hydrogen and carbon atoms, but it is possible that $R^1$ may also comprise heteroatom substituents such as halo, nitro, hydroxyl or alkoxy substituents, particularly if $R^1$ is an aryl group. $R^1$ is more preferably an alkyl group having from 1 to 6 carbon atoms. $R^1$ is most preferably an ethyl group or a methyl group. $R^1$ is suitably chosen such that $R^1$–OH is a compound that may be readily removed from the reaction mixture, e.g. ethanol or methanol.

$R^2$ is chosen from hydrocarbyl or hydrocarbylene comprising from 1 to 30 carbon atoms. In one embodiment, $R^2$ comprises only hydrogen and carbon atoms, but it is possible that $R^2$ may also comprise heteroatom substituents such as halo, nitro, hydroxyl, alkoxy, sulfonyl or ether substituents particularly if $R^2$ is an aryl or arylene group. If n is 1, $R^2$ is monovalent and is chosen from hydrocarbyl comprising from 1 to 30 carbon atoms. If n is more than 1, $R^2$ is multivalent and is chosen from hydrocarbylene comprising from 1 to 30 carbon atoms. When $R^2$ is multivalent the n groups attached to $R^2$ are preferably not all attached to the same carbon atom, but are preferably attached to different carbon atoms in the $R^2$ group. Preferably, n is 2 and $R^2$ is divalent and is chosen from hydrocarbylene comprising from 1 to 30 carbon atoms. Preferably $R^2$ is arylene comprising from 6 to 14 carbon atoms or alkylene comprising from 2 to 12 carbon atoms. Most preferably $R^2$ is arylene comprising from 6 to 14 carbon atoms.

Preferred $R^2$ groups are shown below:

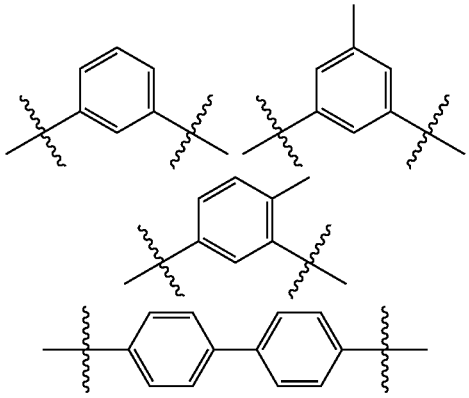

-continued

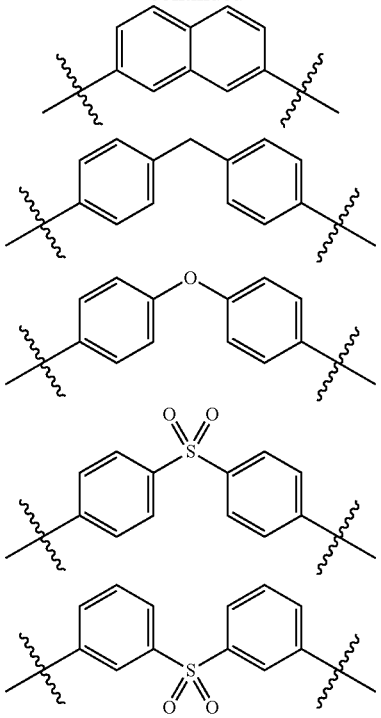

$R^3$ is chosen from hydrocarbyl comprising from 2 to 30 carbon atoms. $R^3$ preferably comprises only hydrogen and carbon atoms, but it is possible that $R^3$ may also comprise heteroatom substituents such as halo, nitro, hydroxyl or alkoxy substituents, particularly if $R^3$ is an aryl group. Preferably $R^3$ is aryl having from 6 to 12 carbon atoms or is alkyl comprising from 2 to 18 carbon atoms. Most preferably the compound of formula (b) is chosen from octylamine, dodecylamine (laurylamine), tetradecylamine (myristylamine), hexadecylamine, octadecylamine (tallow amine, also referred to as stearylamine), oleylamine, aniline, benzyl amine, p-toluidine, p-chloro-aniline or m-xylidine.

n is an integer of 1 or more. Preferably n is from 1 to 4. Most preferably n is 2.

The reaction is suitably carried out from ambient temperature to 240° C., more preferably from 40° C. to 180° C. and most preferably from 100° C. to 160° C. In one embodiment of the invention the reaction may be carried out in the presence of a catalyst such as zinc acetate. If a catalyst is used the reaction temperature may be lower, e.g. from ambient to 100° C. The reaction is preferably carried out in the absence of oxygen, e.g. under nitrogen.

In a first embodiment of the invention the reaction of the compound of formula (a) with the compound of formula (b) is carried out in the presence of a base oil. In a second embodiment of the invention, the compound of formula (c) is formed and then is mixed with a base oil. In the second embodiment it may be necessary to use a solvent for the reaction of the compound of formula (a) with the compound of formula (b), e.g. a polar solvent such as dimethyl sulfoxide.

The base oil may be of mineral origin, synthetic origin, or a combination thereof. Base oils of mineral origin may be mineral oils, for example, those produced by solvent refining or hydroprocessing. Base oils of synthetic origin may typically comprise mixtures of $C_{10}$-$C_{50}$ hydrocarbon polymers, for example, polymers of alpha-olefins, ester type synthetic oils, ether type synthetic oils, and combinations thereof. Base oils may also include Fischer-Tropsch derived highly paraffinic products.

Suitable examples of mineral base oils include paraffinic base oils and naphthenic base oils. Paraffinic base oils typically have a proportion of carbons in aromatic structure (Ca) in a range of from 1 to 10%, in naphthenic structure (Cn) in a range of from 20 to 30% and in paraffinic structure (Cp) in a range of from 60 to 70%. Naphthenic base oils typically have a proportion of carbons in aromatic structure (Ca) in a range of from 1 to 20%, in naphthenic structure (Cn) in a range of from 30 to 50% and in paraffinic structure (Cp) in a range of from 40 to 60%.

Suitable examples of base oils include medium viscosity mineral oils, high viscosity mineral oils, and combinations thereof. Medium viscosity mineral oils have a viscosity generally in a range of from 5 $mm^2/s$ centistokes (cSt) at 100° C. to 15 $mm^2/s$ (cSt) at 100° C., preferably in a range of from 6 $mm^2/s$ (cSt) at 100° C. to 12 $mm^2/s$ (cSt) at 100° C., and more preferably in a range of from 7 $mm^2/s$ (cSt) at 100° C. to 12 $mm^2/s$ (cSt) at 100° C. High viscosity mineral oils have a viscosity generally in a range of from 15 $mm^2/s$ (cSt) at 100° C. to 40 $mm^2/s$ (cSt) at 100° C. and preferably in a range of from 15 $mm^2/s$ (cSt) at 100° C. to 30 $mm^2/s$ (cSt) at 100° C.

Suitable examples of mineral oils that may conveniently be used include those sold by member companies of the Shell Group under the designations "HVI", "MVIN", or "HMVIP". Polyalphaolefins and base oils of the type prepared by the hydroisomerisation of wax, for example, those sold by member companies of the Shell Group under the designation "XHVI" (trade mark), may also be used.

The grease that is the product of the process of the invention comprises the compound of formula (c) as a thickener and a base oil. Preferably the grease comprises a weight percent of the compound of formula (c) based on the total weight of grease in a range of from 2 weight percent to 25 weight percent, more preferably in a range of from 3 weight percent to 20 weight percent, and most preferably in a range of from 5 weight percent to 20 weight percent.

The product of the process of the invention is a grease. Preferably the grease is subjected to further finishing procedures such as homogenisation, filtration and de-aeration.

A grease prepared according to a process of the invention may comprise one or more additives, in amounts normally used in this field of application, to impart certain desirable characteristics to the grease including, for example, oxidation stability, tackiness, extreme pressure properties, corrosion inhibition, reduced friction and wear, and combinations thereof. The additives are preferably added to the grease before the finishing procedures. Most preferably, the grease is homogenised, then the additives are added, and then the grease is subjected to further homogenization.

Suitable additives include one or more extreme pressure/antiwear agents, for example zinc salts such as zinc dialkyl or diaryl dithiophosphates, borates, substituted thiadiazoles, polymeric nitrogen/phosphorus compounds made, for example, by reacting a dialkoxy amine with a substituted organic phosphate, amine phosphates, sulphurised sperm oils of natural or synthetic origin, sulphurised lard, sulphurised esters, sulphurised fatty acid esters, and similar sulphurised materials, organo-phosphates for example according to the formula $(OR)_3P{=}O$ where R is an alkyl, aryl or aralkyl group, and triphenyl phosphorothionate; one or more overbased metal-containing detergents, such as calcium or magnesium alkyl salicylates or alkylarylsulphonates; one or more ashless dispersant additives, such as reaction products of polyisobutenyl succinic anhydride and an amine or ester; one or more antioxidants, such as hindered phenols or amines, for example phenyl alpha naphthylamine, diphenylamine or alkylated diphenylamine; one or more antirust additives such as oxygenated hydrocarbons which have optionally been neutralised with calcium, calcium salts of alkylated benzene sulphonates and alkylated benzene petroleum sulphonates, and succinic acid derivatives, or friction-modifying additives; one or more viscosity-index improving agents; one or more pour point depressing additives; and one or more tackiness agents. Solid materials such as graphite, finely divided $MoS_2$, talc, metal powders, and various polymers such as polyethylene wax may also be added to impart special properties.

A grease prepared according to a process of the invention may comprise from 0.1 weight percent to 15 weight percent, preferably from 0.1 weight percent to 5 weight percent, more preferably from 0.1 weight percent to 2 weight percent, and even more preferably from 0.2 weight percent to 1 weight percent of one or more additives based on the total weight of grease.

The greases produced by the process of the invention are suitably used in typical applications for lubricating greases such as in constant-velocity joints, ball joints, wheel bearings, alternators, cooling fans, ball screws, linear guides of machine tools, sliding areas of construction equipment, and bearings and gears in steel equipment and various other industrial mechanical facilities.

The invention further provides a lubricating grease comprising a compound of formula (c):

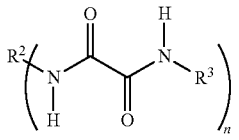

(c)

wherein $R^2$ is chosen from hydrocarbyl or hydrocarbylene comprising from 1 to 30 carbon atoms, $R^3$ is chosen from hydrocarbyl comprising from 2 to 30 carbon atoms and n is an integer of 2 or more; and a base oil. Preferred features of the grease (including preferred $R^2$ and $R^3$ groups) are as described above for the grease produced by the process of the invention. n is preferably 2.

In an alternative embodiment, the present invention provides a process for preparing a lubricating grease comprising a step in which a compound of formula (a) is reacted with a compound of formula (d) to provide a compound of formula (e):

(a)

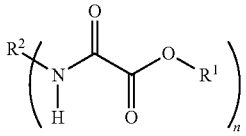

(d)

$H_2N—R^2—NH_2$ (e)

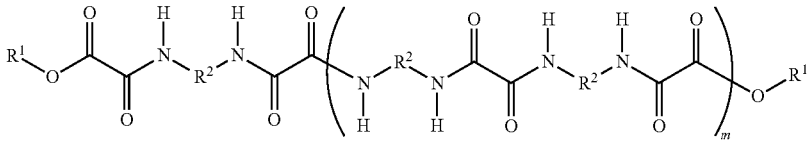

and a step wherein the compound of formula (e) is reacted with a compound of formula (b) to provide a compound of formula (f):

(b)

$R^3—NH_2$ (f)

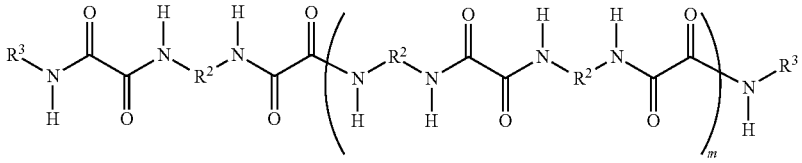

wherein $R^1$ is chosen from hydrocarbyl having from 1 to 30 carbon atoms, $R^2$ is chosen from hydrocarbylene comprising from 1 to 30 carbon atoms, $R^3$ is chosen from hydrocarbyl comprising from 2 to 30 carbon atoms, n is 2 and m is an integer of 1 or more, and wherein the reaction of the compound of formula (e) with the compound of formula (b) is carried out in the presence of a base oil, or the compound of formula (f) is mixed with a base oil.

Preferred $R^1$ and $R^3$ groups are as described above. Preferred $R^2$ groups are chosen from the preferred divalent $R^2$ groups as described above.

In one embodiment, two moles of compound (a) are reacted with one mole of compound (d) and this is likely to provide compound (e) and then (f) wherein m is 1. In another embodiment, two moles of compound (a) are reacted with one mole of compound (d) and then further reacted with another mole of compound (d), and this is likely to provide compound (f) wherein m is 2 or more.

EXAMPLES

The invention is further explained in detail below by means of examples, but the invention is in no way limited by these examples.

Example 1

100 mg (0.27 mmol) of compound (1) was dissolved in base oil (1 ml) and was heated to 130° C. under a stream of nitrogen.

(1)

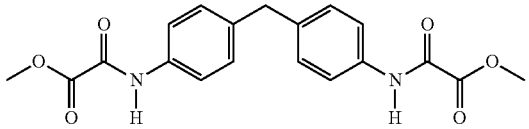

Then octylamine (150 mg, 1.16 mmol) was added. The mixture immediately formed a grease.

In another experiment a small amount of compound (1) was dissolved in DMSO-d6. A few drops of octylamine were added. The mixture was added to a NMR tube and was heated with a hotgun for three periods of two minutes. The conversion was 95%. NMR indicated that a compound of formula (2) was formed:

(2)

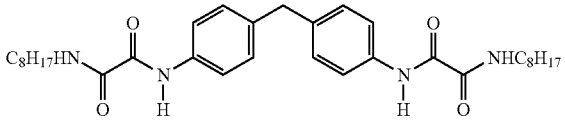

Example 2

500 mg (1.35 mmol) of compound (1) was dissolved in base oil (6.86 g). Octylamine (2.83 mmol, 368.42 mg) was added. The mixture was heated to 150° C. and stirred for 1 hour during which a white grease was formed. NMR indicated that the reaction was not complete, giving approximately 50% conversion to product (2). Stirring for a longer period did not improve conversion.

Example 3

3 g (8.1 mmol) of compound (1) was dissolved in base oil (86.9 g). Octylamine (17.82 mmol, 2.3 g) was added. The mixture was heated to 160° C. for 1 hour and then to 200° C. Within 2 hours, the reaction had achieved greater than 90% conversion to compound (2). A grease formed upon cooling.

Example 4

973 mg (2.44 mmol) of compound (1) was dissolved in base oil (7.8 g). Octylamine (5.37 mmol, 0.9 ml) and zinc acetate (27 mg, 5 mol %) were added. The mixture was heated to 95° C. for 15 minutes. A grease formed and NMR showed a conversion of approximately 50% to compound (2).

Example 5

3 g (9.7 mmol) of compound (3) was dissolved in base oil (25.28 g). Benzylamine (21.4 mmol, 2.29 g) was added. The mixture was heated under nitrogen to 160° C. The reaction achieved approximately 94% conversion to compound (4). A grease formed upon cooling.

(3)

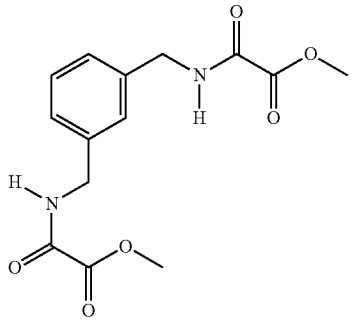

(4)

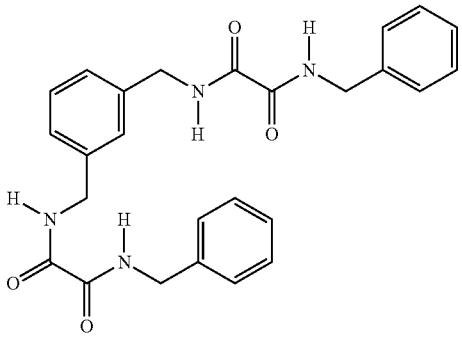

Example 6

1.46 g (4.74 mmol) of compound (3) was dissolved in base oil (13.5 g). Octylamine (10.4 mmol, 1.7 ml) was added. The mixture was heated under nitrogen to 160° C. After 2 hours the reaction achieved 95% conversion to compound (5). Heating to 200° C. and cooling gave a thick grease.

(5)

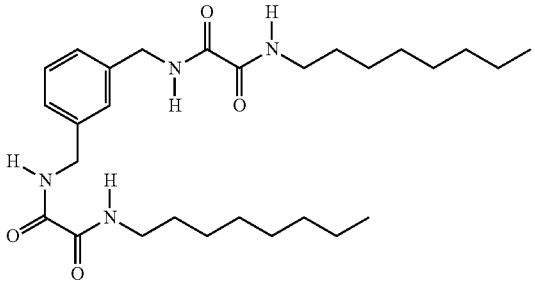

Example 7

1.08 g (3.42 mmol) of compound (6) was dissolved in base oil (9.7 g). Benzylamine (7.52 mmol, 0.82 ml) was added. The mixture was heated at 160° C. for 2 hours. NMR showed approximately 90% conversion to compound (7). A grease was obtained.

(6)

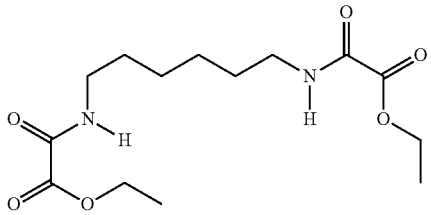

(7)

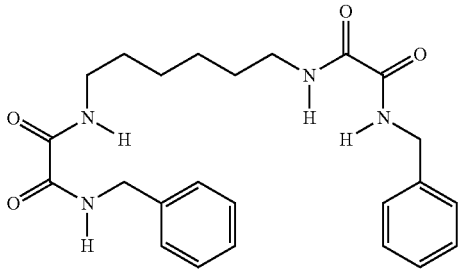

Example 8

1.15 g (3.65 mmol) of compound (8) was dissolved in base oil (10 g). Octylamine (7.8 mmol, 1.3 ml) was added. The mixture was heated at 150° C. for 2 hours. Approximately 90% conversion to compound (9) was achieved. A grease was obtained.

(8)

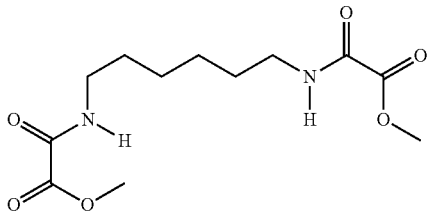

-continued (9)

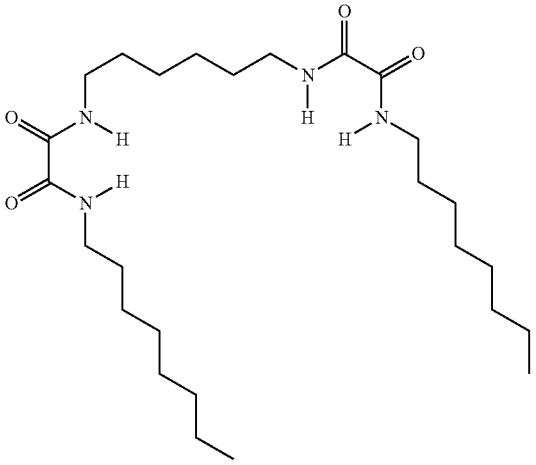

(10)

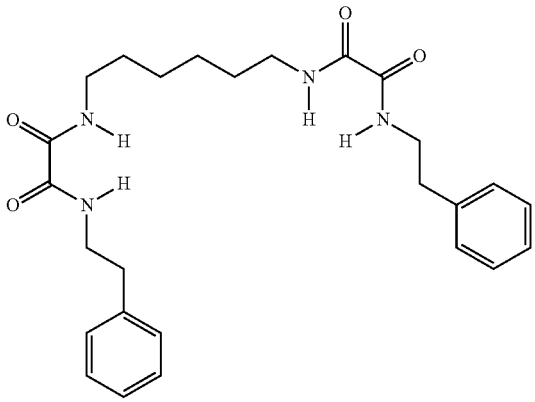

Example 9

1.21 g (3.82 mmol) of compound (8) was dissolved in base oil (10 g). Phenethylamine (8 mmol, 1 ml) was added. The mixture was heated at 150° C. for 2 hours. Approximately 85% conversion to compound (10) was achieved. A grease was obtained after stirring at 170° C. for 2 hours and cooling directly without stirring on ice.

Example 10

822 mg (2.06 mmol) of compound (1) was dissolved in base oil (10.2 g). (+)-dehydroabietylamine (4.54 mmol, 1.44 g) was added. The mixture was heated at 150° C. for 2 hours. Approximately 85% conversion to compound (11) was achieved. A grease was obtained after stirring at 170° C. for 2 hours and cooling directly without stirring on ice.

(11)

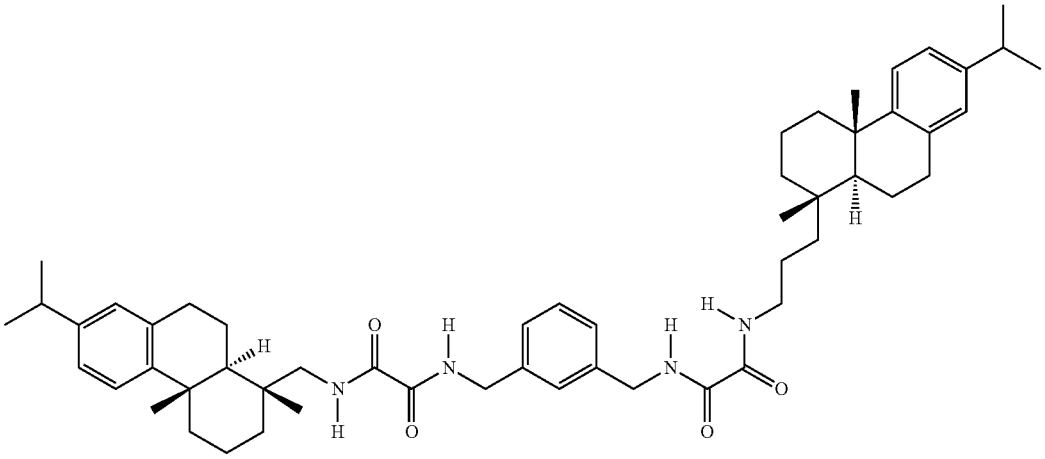

Example 11

20 g (54 mmol) of compound (1) was dissolved in dichloroethane (300 ml). Octylamine (113.4 mmol, 14.66 g) was added. The mixture was stirred overnight at room temperature. NMR showed 50% conversion to compound (2). A thick solid formed during the night. The mixture was heated up to reflux for 2 hours. NMR showed 74% conversion to compound (2). After another 2 hours of reflux, NMR showed 79% to compound (2). Additional octylamine (3 g, 23.2 mmol) was added. The mixture was stirred for an additional hour. The mixture was cooled to 30° C. and filtered. The white solid was washed with dichloroethane and dried at the air during the weekend. 28.91 g of compound (2), a white fluffy solid, was obtained (51.9 mmol, 95% conversion, DSC indicated 251.32° C.)

2.5 g of compound (2) was suspended in base oil (14.165 g) and heated up to 190° C. It becomes a white thin yoghurt-like mixture. The mixture was cooled rapidly in water to room temperature; no change was observed. The mixture was heated again to 210° C. and was cooled to room temperature overnight without stirring. A grease was formed. The mixture was heated to 250° C. and cooled again. A thick grease was formed.

Example 12

15.3 g (47.5 mmol) of compound (12) was dissolved in base oil (132 g). Octylamine (17.3 ml, 104.5 mmol) was added and the mixture was heated at 150° C. for 2 hours. A grease was formed. NMR shows only compound (13).

(12)

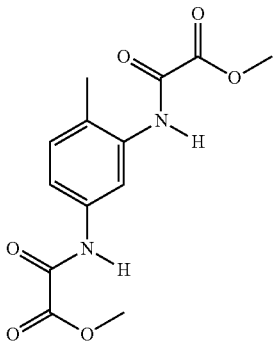

-continued (13)

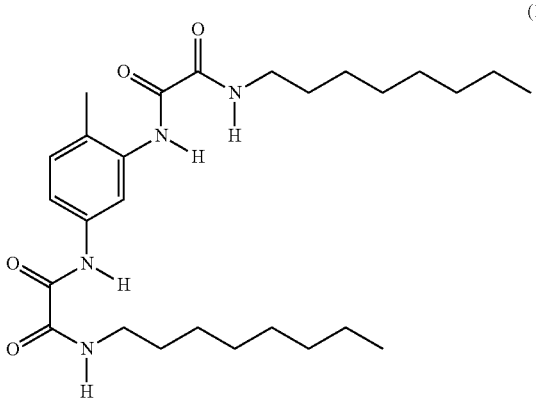

Example 13

2-ethyl-1-hexylamine (3.6 ml, 21.9 mmol) was added to compound (14) (3.97 g, 9.97 mmol) in base oil (31.9 g). The mixture was heated at 160° C. for 2 hours. NMR shows ~80% of compound (15). Cooling to room temperature without stirring gave a grease.

(14)

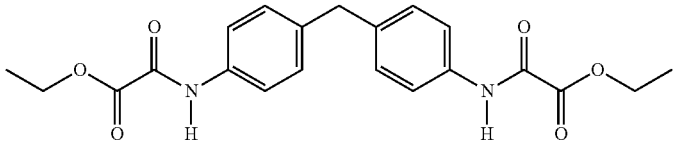

(15)

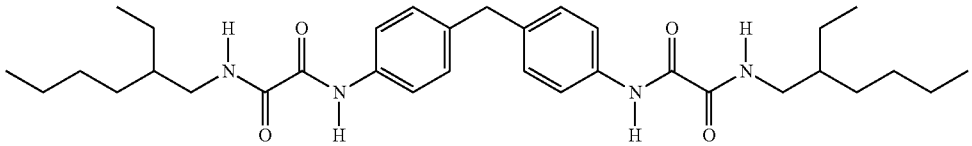

Example 14

Cyclohexylamine (40 g, 403 mmol) was added to compound (14) (10 g, 25 mmol). The mixture was stirred at 130° C. for 1 hour and a white precipitate formed. Heptanes (40 ml) were added and the white precipitate was filtered and washed with heptanes. The solid was warmed to 50° C. in heptanes and stirred for 1 hour. After cooling the mixture was filtered and washed with heptanes. 11.7 g (23.2 mmol, 93%) of compound (16) was isolated.

3 g of compound (16) was added to base oil (17 g). The mixture was stirred for 5 minutes at room temperature. It was then heated slowly to 230° C. The mixture became thicker and thicker and did not dissolve or melt. The mixture was cooled to room temperature, giving a grease.

(16)

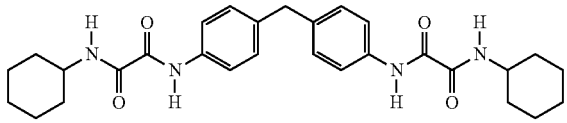

Example 15

Benzylamine (0.96 ml, 8.78 mmol) was added to compound (12) (1.29 g, 3.99 mmol) in base oil (10 g). The mixture was heated at 150° C. for 1 hour. There was 85% conversion to compound (17) and formation of a grease.

(17)

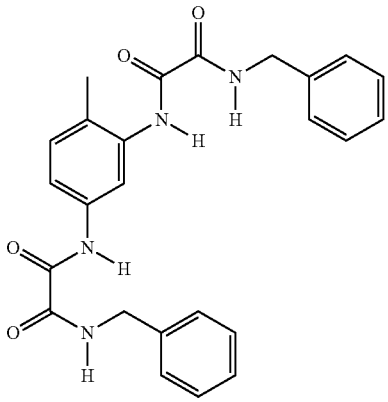

Example 16

2-ethyl-1-hexylamine (4.65 ml, 28.4 mmol) was added to compound (12) (4.16 g, 12.9 mmol) in base oil (35.7 g). The mixture was heated at 160° C. for 2 hours. Cooling to room temperature without stirring gave a soft grease that contained compound (18).

(18)

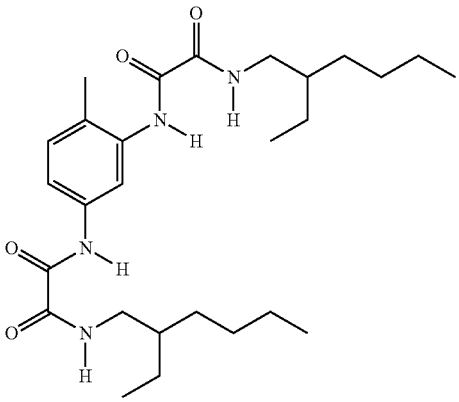

Example 17

Octylamine (1.35 ml, 8.14 mmol, 2.2 equiv.) was added to compound (19) (1.16 g, 3.77 mmol) in base oil (10 g). The mixture was heated at 160° C. After 15 minutes a grease that contained compound (20) was formed.

(19)

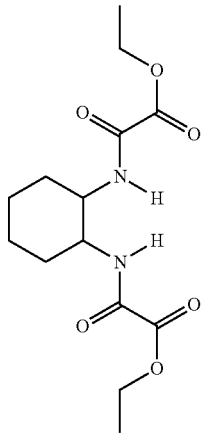

(20)

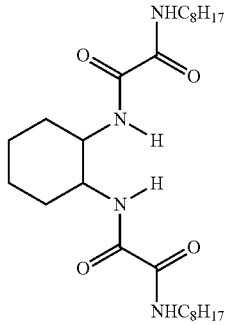

Example 18

2-ethyl-1-hexylamine (4.4 ml, 27 mmol, 2.2 equiv.) was added to 3.87 g (12.3 mmol) of compound (19) (1/1 cis/trans) in base oil (33.5 g). The mixture was heated at 160° C. for 2 hours. Cooling to room temperature without stirring gave a soft grease that contained compound (21).

(21)

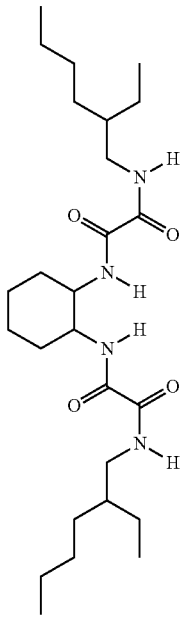

Example 19

Base oil (27.4 g) and octadecylamine (4.22 g, 15.64 mmol) were added to a cis-trans mixture of compound (19) (2 g, 6.4 mmol). The mixture was heated to 160° C. for 2 hours. The mixture was cooled to room temperature without stirring. A grease that contained compound (22) was obtained.

(22)

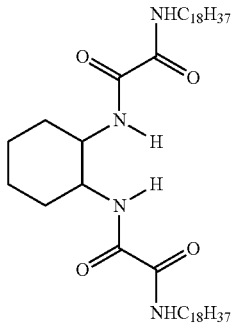

Example 20

Compound (23) (10.8 g, 41.5 mmol) was stirred in base oil (96.6 g). Benzylamine (2.2 equiv.) was added and the mixture was stirred at 160° C. for 2 hours. The mixture was cooled to room temperature, giving a grease that contained compound (24).

(23)

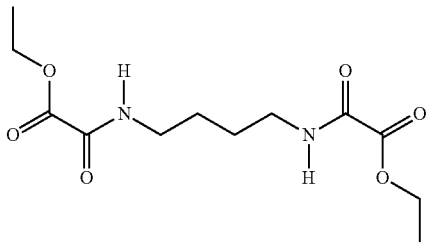

(24)

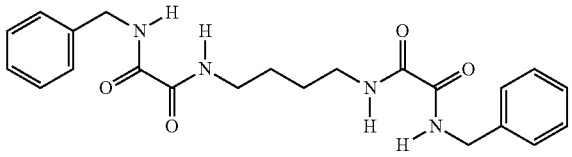

Example 21

Compound (25) (1.9 g, 4.76 mmol) was stirred in base oil (15.07 g). 2-ethyl-1-hexylamine (2.2 equiv.) was added and the mixture was stirred at 160° C. Within 20 minutes a grease was formed. The grease contained compound (26).

(25)

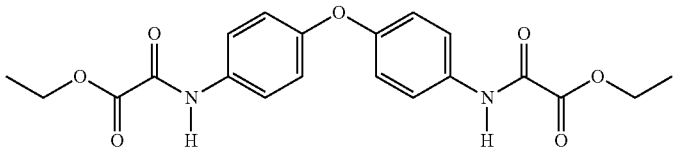

(26)

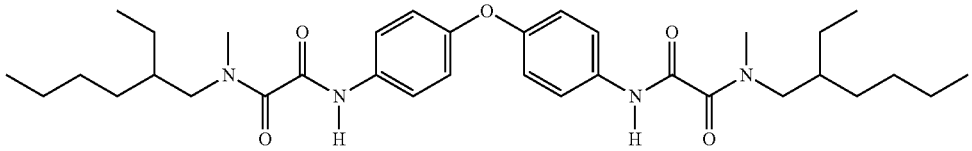

Example 22

Compound (27) (2.07 g, 4.6 mmol) was stirred in base oil (16.1 g). Octylamine (2.2 equiv.) was added and the mixture was stirred at 160° C. for 2 hours. NMR showed >95% conversion to compound (28). Cooling to room temperature gave a grease.

(27)

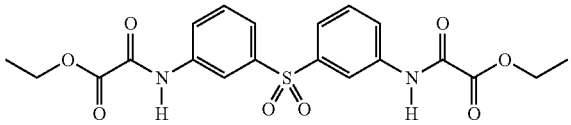

(28)

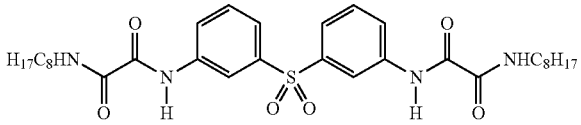

Example 23

Compound (27) (2.33 g, 5.2 mmol) was stirred in base oil (16.4 g). 2-ethyl-1-hexylamine (2.2 equiv.) was added and the mixture was stirred at 160° C. for 2 hours. The mixture quickly became thicker. Cooling to room temperature gave a grease that contained compound (29).

(29)

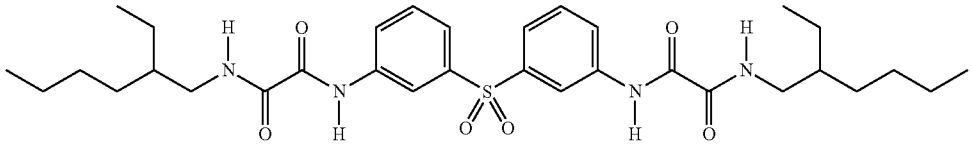

Example 24

Compound (27) (8.3 g, 18.5 mmol) was stirred in base oil (93.9 g). Octadecylamine (2.1 equiv.) was added and the mixture was stirred at 160° C. for 2 hours. The mixture slowly became thicker. NMR showed near complete conversion to compound (30). Cooling to room temperature gave a grease.

(30)

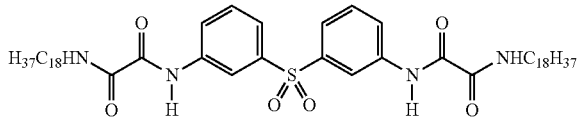

Grease Properties

Greases were prepared from the compounds according to formula (c) as outlined above. Each grease contained 15 wt % of the compound of formula (c) and 85 wt % of HVI 120, a Group I base oil. The greases were tested by Differential Scanning calorimetry (DSC) to determine their melting points. The samples of the isolated thickener were heated under nitrogen atmosphere from 25-400° C. in a differential scanning calorimeter at a rate of 10° C./min. The melting point is indicated by a deviation from the linear heat flow. The dropping point was determined according to IP 396 and the difference between worked and unworked penetration was determined according to DIN ISO 2137. The results are shown in Table 1:

TABLE 1

| Compound of formula (c) | Melting point (° C.) | Dropping Point (° C.) | Delta penetration (unworked/worked) |
|---|---|---|---|
| (2) | 251 | 224 | 45 |
| (13) | 177 | 165 | — |
| (15) | 191 | 182 | 8 |
| (16) | 301 | 276 | — |
| (17) | 223 | 191 | — |
| (18) | — | 164 | — |
| (20) | 209 | 279 | — |
| (21) | 209 | 165 | 70 |
| (22) | — | 141 | 119 |
| (24) | 278 | 249 | 15 |
| (26) | 182 | 177 | 9 |
| (28) | 199 | 197 | 19 |
| (29) | 272 | 157 | −34 |
| (30) | 181 | 116 | 95 |

It is preferred to have a melting point of 180° C. or higher and many of the greases have melting points in this range. The delta penetration is preferably minimised (this is evidence of good mechanical stability) and several of the greases have low or very low delta penetration.

That which is claimed is:

1. A process for preparing a lubricating grease comprising a step in which a compound of formula (a) is reacted with a compound of formula (b) to provide a compound of formula (c):

(a)

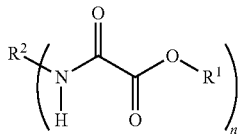

(b)

$R^3—NH_2$ (c)

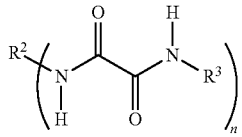

wherein $R^1$ is chosen from hydrocarbyl having from 1 to 30 carbon atoms, $R^2$ is chosen from hydrocarbyl or hydrocarbylene comprising from 1 to 30 carbon atoms, $R^3$ is chosen from hydrocarbyl comprising from 2 to 30 carbon atoms and n is an integer of 2, wherein the reaction of the compound of formula (a) with the compound of formula (b) is carried out in the presence of a base oil, or the compound of formula (c) is mixed with a base oil; and wherein the lubricating grease has a melting point of 180° C. or higher.

2. The process according to claim 1, wherein $R^1$ is an alkyl group having from 1 to 6 carbon atoms.

3. The process according to claim 1, wherein n is 2 and $R^2$ is chosen from arylene comprising from 6 to 14 carbon atoms or alkylene comprising from 2 to 12 carbon atoms.

4. The process according to claim 1, wherein $R^3$ is aryl having from 6 to 12 carbon atoms or is alkyl comprising from 2 to 18 carbon atoms.

5. The process according to claim 1, wherein the lubricating grease comprises the compound of formula (c) in a range of from 2 weight percent to 25 weight percent, based on the total weight of the lubricating grease.

6. A lubricating grease comprising a compound of formula (c):

(c)

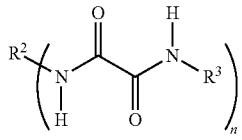

wherein $R^2$ is chosen from hydrocarbyl or hydrocarbylene comprising from 1 to 30 carbon atoms, $R^3$ is chosen from hydrocarbyl comprising from 2 to 30 carbon atoms and n is an integer of 2, and a base oil; and wherein the lubricating grease has a melting point of 180° C. or higher.

7. The lubricating grease according to claim 6, wherein $R^2$ is chosen from arylene comprising from 6 to 14 carbon atoms or alkylene comprising from 2 to 12 carbon atoms.

8. The lubricating grease according to claim 6, wherein $R^3$ is aryl having from 6 to 12 carbon atoms or is alkyl comprising from 2 to 18 carbon atoms.

9. The lubricating grease according to claim 6, wherein the lubricating grease comprises the compound of formula (c) in a range of from 2 weight percent to 25 weight percent, based on the total weight of the lubricating grease.

10. The process for preparing a lubricating grease comprising a step in which a compound of formula (a) is reacted with a compound of formula (d) to provide a compound of formula (e):

(a)

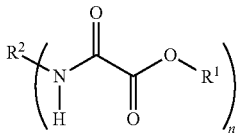

(d)

$H_2N—R^2—NH_2$ (e)

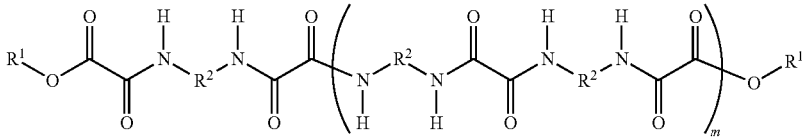

and a step wherein the compound of formula (e) is reacted with a compound of formula (b) to provide a compound of formula (f):

(b)

$R^3—NH_2$ (f)

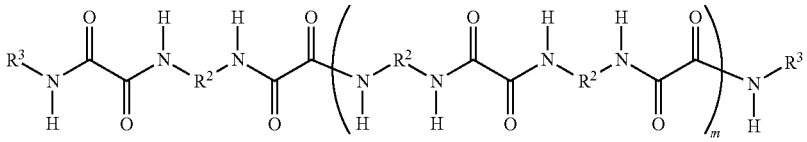

wherein $R^1$ is chosen from hydrocarbyl having from 1 to 30 carbon atoms, $R^2$ is chosen from hydrocarbylene comprising from 1 to 30 carbon atoms, $R^3$ is chosen from hydrocarbyl comprising from 2 to 30 carbon atoms, n is 2 and m is an integer of 1 or more, and wherein the reaction of the compound of formula (e) with the compound of formula (b) is carried out in the presence of a base oil, or the compound of formula (f) is mixed with a base oil.

* * * * *